US005891388A

United States Patent [19]

Baik et al.

[11] Patent Number: 5,891,388

[45] Date of Patent: Apr. 6, 1999

[54] FE-MN VIBRATION DAMPING ALLOY STEEL HAVING SUPERIOR TENSILE STRENGTH AND GOOD CORROSION RESISTANCE

[75] Inventors: Seung-Han Baik; Yong-Chul Son; Jung-Chul Kim; Dong-Woon Han, all of Kyungki-do, Rep. of Korea

[73] Assignee: Woojin Inc., Rep. of Korea

[21] Appl. No.: 969,913

[22] Filed: Nov. 13, 1997

[51] Int. Cl.[6] ..... C22C 38/38; C22C 38/04

[52] U.S. Cl. ..... 420/72; 420/74; 420/75; 420/76

[58] Field of Search ..... 420/72, 74–76

[56] References Cited

U.S. PATENT DOCUMENTS

| | | | |
|---|---|---|---|
| 4,788,034 | 11/1988 | Brandis et al. | 420/74 |
| 4,875,933 | 10/1989 | Wan . | |
| 5,290,372 | 3/1994 | Choi et al. . | |
| 5,634,990 | 6/1997 | Choi et al. . | |

FOREIGN PATENT DOCUMENTS

| | | | |
|---|---|---|---|
| 55-091956 | 7/1980 | Japan . | |
| 58-96853 | 6/1983 | Japan | 420/74 |

OTHER PUBLICATIONS

Hansen and Anderko, *Constitution of Binary Alloys,* second edition, McGraw–Hill Book Company, Inc. (1958): pp. 664–668.

Abstract corresponding to Japanese Patent Publication No. 55–091956 (see above), Jul. 11, 1980.

*Primary Examiner*—Deborah Yee

*Attorney, Agent, or Firm*—Cooper & Dunham LLP

[57] ABSTRACT

An Fe—Mn Vibration Damping alloy steel having a superior tensile strength is disclosed. The alloy steel consists of, by weight percent: 10 to 24% of Manganese(Mn); up to 0.2% of carbon(C); at least one element selected from the group consisting of 0.1 to 2.0% of Titanium(Ti), 0.1 to 2.0% of Molybdenium(Mo), 0.1 to 1.0% of Vanadium(V), and 0.1 to 0.7% of Tungsten(W), the element increasing a tensile strength of the vibration damping alloy steel; and remaining iron(Fe) and incidental impurities. Further, an Fe—Mn vibration damping alloy steel having a good corrosion resistance is disclosed. The alloy steel consists of, by weight percent: 10 to 24% of Manganese(Mn); up to 0.2% of carbon(C); at least one element selected from the group consisting of 0.1 to 4.5% of Chromium(Cr), 0.1 to 1.5% of Copper(Cu), and 0.1 to 1.1% of Niobium (Nb), the element increasing a corrosion resistance of the vibration damping alloy steel; and remaining iron (Fe) and incidental impurities.

2 Claims, 11 Drawing Sheets

Fe-17%Mn-0.2%C-0.1%Cr Alloy(Inventive Steel)

Carbon Steel(SC46),(Conventional Steel)

Gray Cast Iron(FC20),(Conventional Steel)

Allomorphic Iron Reinforced Bar(Conventional Steel)

Fe-17%Mn(Conventional Steel)

FE-MN VIBRATION DAMPING ALLOY STEEL HAVING SUPERIOR TENSILE STRENGTH AND GOOD CORROSION RESISTANCE

FIELD OF THE INVENTION

The present invention relates to an Fe—Mn vibration damping alloy steel, which contains alloy elements as additives, and which thereby has a much improved tensile strength and a much improved corrosion resistance as well as a superior vibration damping capacity, in comparison with conventional types of steel.

DESCRIPTION OF THE PRIOR ART

U.S. Pat. No. 5,290,372 issued to Choi et al. discloses a conventional vibration damping alloy steel which has a partial martensite structure in which 10~22% by weight of Mn is added to a base of Fe.

The conventional vibration damping alloy steel reveals a superior vibration damping capacity and thereby functions as a new promising material to a certain degree in the fields using the vibration damping alloy steel.

However, recent trends of higher buildings, longer bridges, and faster transportation in the alloy steel-using fields inevitably requires that the strength of the used steel be sufficiently high, and accordingly that the vibration damping alloy steel have further superior tensile strength. Moreover, the improvement of the tensile strength of the alloy steel enables reduction of its weight and its manufacturing cost.

Meanwhile, the corrosion resistance is very important because a possible corrosion of constructional material may shorten the life of the steel-constructed structure and may even cause an enormous disaster. That is, the corrosion problem has a great importance in views of cost, safety, environment and natural resources.

SUMMARY OF THE INVENTION

The present invention has been made to overcome the above described problems of the prior arts, and accordingly it is an object of the present invention to provide a vibration damping alloy steel which has a superior tensile strength.

It is another object of the present invention to provide a vibration damping alloy steel which has a superior corrosion resistance.

To achieve the above objects, the present invention provides an Fe—Mn vibration damping alloy steel having a superior tensile strength, consisting of, by weight percent:

10 to 24% of Manganese(Mn); up to 0.2% of carbon(C); at least one element selected from the group consisting of 0.1 to 2.0% of Titanium(Ti), 0.1 to 2.0% of Molybdenium (Mo), 0.1 to 1.0% of Vanadium (V), and 0.1 to 0.7% of Tungsten(W), the element increasing a tensile strength of the vibration damping alloy steel; and remaining iron(Fe) and incidental impurities.

The present invention further provides a vibration damping alloy steel having a good corrosion resistance, cosisting of, by weight percent:

10 to 24% of Manganese(Mn); up to 0.2% of carbon(C); at least one element selected from the group consisting of 0.1 to 4.5% of Chromium(Cr), 0.1 to 1.5% of Copper(Cu), and 0.1 to 1.1% of Niobium (Nb), the element increasing a corrosion resistance of the vibration damping alloy steel; and remaining iron(Fe) and incidental impurities.

BRIEF DESCRIPTION OF THE DRAWINGS

The above and other objects, features, advantages of the present invention will become apparent from a review of the following detailed description of the preferred embodiment taken in conjunction with the accompanying drawings, in which.

DETAILED DESCRIPTION OF THE PREFERRED EMBODIMENT

Hereinafter, vibration damping alloy steels according to several embodiments of the present invention will be described in detail.

According to the first embodiment of the present invention, at least one element is selected from the group consisting of Ti, Mo, V, and W, and is added to a vibration damping alloy steel, so as to improve the tensile strength of the vibration damping alloy steel.

In the vibration damping alloy steel according to the first embodiment of the present invention which has a superior tensile strength, percentages by weight of respective elements are limited within the following ranges and with the following reasons.

The damping mechanism is in relation to $\gamma/\epsilon$ interface as described in U.S. Pat. No. 5,290,372, and thereby Mn is limited to 10 to 24% by weight as a range for enlarging $\gamma/\epsilon$ interface.

C is limited to not more than 0.2% by weight which quantity is inevitably mixed into the vibration damping alloy steel in a melting furnace.

Ti is limited to 0.1 to 2.0% by weight, Mo to 0.1 to 2.0% by weight, V to 0.1 to 1.0% by weight, and W to 0.1 to 0.7% by weight, because each range is necessary for improving the tensile strength of the vibration damping alloy steel, and because the vibration damping capacity of the vibration damping alloy steel is greatly deteriorated out of those ranges.

In the vibration damping alloy steel according to the second embodiment of the present invention, percentages by weight of Cr, Cu, and Nb, which are elements for improving the corrosion resistance, are respectively limited within certain ranges which ranges are also limitations for improving the corrosion resistance. In addition, the vibration damping capacity of the vibration damping alloy steel is greatly deteriorated out of those ranges.

The vibration damping alloy steels having an improved tensile strength and an improved corrosion resistance according to the first and second embodiments are manufactured as follows.

At first, iron is charged into a melting furnace and heated at a temperature of at least 1500° C.

Then, at least one element for improving the tensile strength or the corrosion resistance is added to the melted iron.

Thereafter, the melted mixture is cast into a mold to produce an ingot.

Subsequently, the cast ingot is homogenized at 1000° C. for 12 to 40 hours and then the homogenized ingot is hot-rolled to produce a rolled metal of a predetermined dimension.

The rolled metal is heated at 900° C. to 1100° C. for 30 to 60 minutes and cooled by air or water to produce the vibration damping alloy steel.

Figure 9:
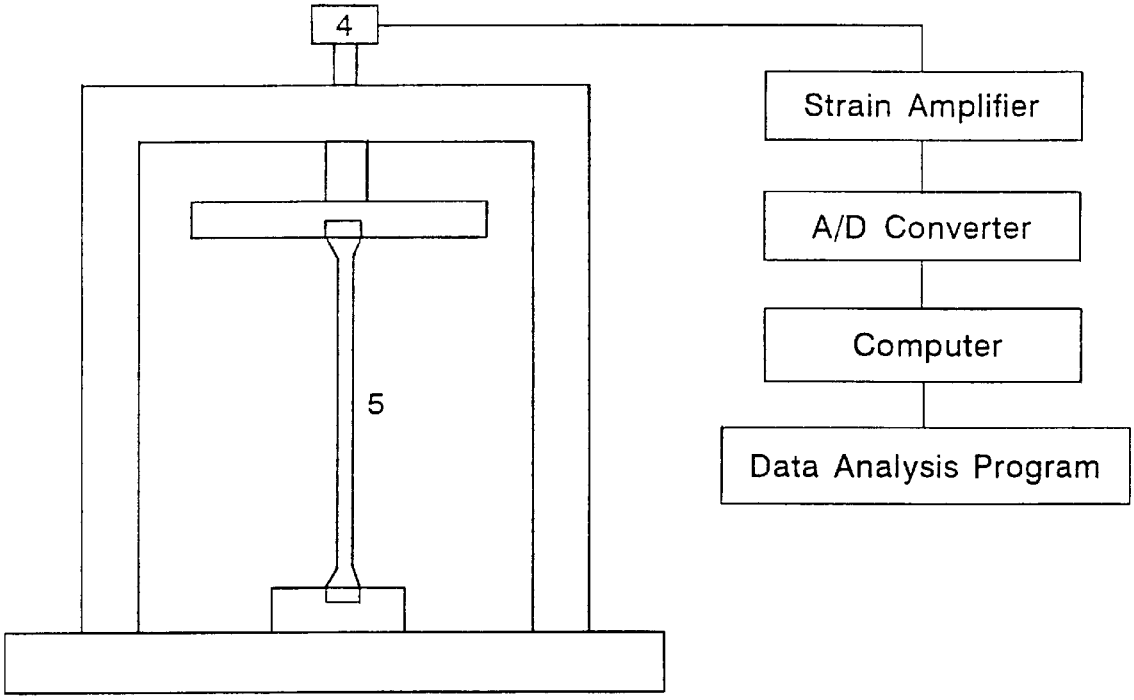
FIG. 9 is a schematic view of an apparatus for measuring the vibration damping capacity of the vibration damping alloy steel according to the present invention.

The vibration damping capacity of the produced vibration damping alloy steel is measured by a Föpple-Pertz type torsional pendulum measuring apparatus as schematically shown in FIG. 9.

In the apparatus, a potentiometer(4) senses the gradual decrease of the amplitude of the vibration with passage of time after a test piece(5) is free-vibrated, and the sensed amplitude changes are amplified by an amplifier and then converted to signals through an analog-to-digital(A/D) converter. The converted signals form a curve in a graph of amplitude-to-time. Through the above steps, the specific vibration damping capacity according to the change of strain is measured.

The first and second embodiments of the present invention will be described in detail hereinbelow.

EXAMPLE 1

In order to manufacture a vibration damping alloy steel having an improved tensile strength, iron is firstly charged into a melting furnace and heated at 1600° C. Then, predetermined amounts of Ti, Mo, V, and W together with manganese are charged into the furnace and then melted, respectively as shown in table 1. Thereafter, the melted mixture is cast into a mold to produce an ingot. Subsequently, the cast ingot is homogenized at 1200° C. for 20 hours and then the homogenized ingot is hot-rolled to produce a rolled metal of a predetermined dimension. The rolled metal is heated at 1000° C. for 40 minutes and cooled by air or water to produce an Fe—Mn type vibration damping alloy steel.

The tensile strength of the manufactured Fe—Mn type vibration damping alloy steel is measured by a tester available as an Instron universal tester of model No. 1127, and a test piece of JIS (Japan Industrial Standard) No. 8 Type C is used in the measurement.

Table 1 and FIGS. 1 to 4 show the composition of the alloys produced according the above process, and its vibration damping capacites and tensile strengths. The vibration damping alloy steels of the present Example, No. 1 to No. 21, contain the tensile strength improving elements within the predetermined ranges according to the present invention, while the comparative steels, No. 22 to No. 30, contain the tensile strength improving elements which are out of the predetermined ranges, and the conventional steels, No. 31 and No. 32, are the conventional vibration damping alloy steel and the conventional carbon steel, which do not contain the tensile strength improving elements.

In the vibration damping alloy steels of the present example, No. 1 to No. 4 steels contain only Ti as the tensile strength improving element, No. 12 to No. 15 steels contain only Mo, No. 16 to No. 18 steels contain only V, No. 19 to No. 21 steels contain only W, and No. 5 to No. 11 steels contain at least two elements selected from the group consisting of Ti, Mo, V, and W as the tensile strength improving elements.

TABLE 1

| No. | Name of alloy | Specific Damping Capacity (SDC, %) $\epsilon = 8 \times 10^{-4}$ | Tensile Strength (kgf/mm$^2$) | Note |
|---|---|---|---|---|
| 1 | Fe-17% Mn-0.2% C-0.1% Ti | 19 | 105 | Inventive steel |
| 2 | Fe-17% Mn-0.2% C-0.5% Ti | 24 | 112 | |
| 3 | Fe-17% Mn-0.2% C-1.0% Ti | 26 | 108 | |
| 4 | Fe-17% Mn-0.2% C-2.0% Ti | 23 | 103 | |
| 5 | Fe-17% Mn-0.2% C-0.2% Ti-0.2% Mo | 25 | 110 | |
| 6 | Fe-17% Mn-0.2% C-0.2% Ti-0.3% V | 25 | 108 | |
| 7 | Fe-17% Mn-0.2% C-0.2% Ti-0.2% W | 26 | 109 | |
| 8 | Fe-17% Mn-0.2% C-0.2% Ti-0.1% Mo-0.2% V | 25 | 110 | |
| 9 | Fe-17% Mn-0.2% C-0.2% Ti-0.1% Mo-0.1% W | 26 | 111 | |
| 10 | Fe-17% Mn-0.2% C-0.2% Mo-0.1% V-0.2% W | 24 | 105 | |
| 11 | Fe-17% Mn-0.2% C-0.1% Ti-0.1% Mo-0.2% V-0.1% Ti | 24 | 112 | |
| 12 | Fe-17% Mn-0.2% C-0.1% Mo | 20 | 100 | |
| 13 | Fe-17% Mn-0.2% C-0.5% Mo | 24 | 107 | |
| 14 | Fe-17% Mn-0.2% C-1.0% Mo | 26 | 108 | |
| 15 | Fe-17% Mn-0.2% C-2.0% Mo | 22 | 103 | |
| 16 | Fe-17% Mn-0.2% C-0.1% V | 20 | 101 | |
| 17 | Fe-17% Mn-0.2% C-0.4% V | 26 | 108 | |
| 18 | Fe-17% Mn-0.2% C-0.8% V | 25 | 106 | |
| 19 | Fe-17% Mn-0.2% C-0.1% W | 22 | 107 | |

TABLE 1-continued

| No. | Name of alloy | Specific Damping Capacity (SDC, %) $\epsilon = 8 \times 10^{-4}$ | Tensile Strength (kgf/mm$^2$) | Note |
|---|---|---|---|---|
| 20 | Fe-17% Mn-0.2% C-0.3% W | 27 | 112 | |
| 21 | Fe-17% Mn-0.2% C-0.6% W | 24 | 110 | |
| 22 | Fe-17% Mn-0.2% C-2.5% Ti | 17 | 94 | Comparative |
| 23 | Fe-17% Mn-0.2% C-3.5% Ti | 14 | 87 | steel |
| 24 | Fe-17% Mn-0.2% C-2.5% Mo | 18 | 93 | |
| 25 | Fe-17% Mn-0.2% C-3.5% Mo | 13 | 83 | |
| 26 | Fe-17% Mn-0.2% C-1.2% V | 18 | 96 | |
| 27 | Fe-17% Mn-0.2% C-2.5% V | 12 | 85 | |
| 28 | Fe-17% Mn-0.2% C-0.9% W | 19 | 101 | |
| 29 | Fe-17% Mn-0.2% C-1.5% W | 16 | 94 | |
| 30 | Fe-17% Mn-0.2% C | 11 | 97 | |
| 31 | Fe-17% Mn | 25 | 65 | Conventional |
| 32 | Carbon Steel(SS41) | 5 | 45 | steel |

Referring to Table 1 and FIGS. 1 to 4, No. 1 to No. 21 vibration damping alloy steels of the present invention reveal superior vibration damping capacities and superior tensile strengths to No. 22 to 29 comparative steels which have tensile strength improving elements but out of the predetermined ranges, and to No. 30 comparative steel which has no tensile strength improving element.

In comparison with No. 31 steel which is the conventional Fe—Mn binary vibration damping alloy steel, No. 1 to No. 21 vibration damping alloy steels of the present invention reveal similar vibration damping capacities but tensile strengths of nearly two times.

In addition, No. 1 to No. 21 vibration damping alloy steels of the present invention reveal vibration damping capacities of about five times and tensile strengths of nearly two and a half times bigger than those of No. 32 conventional carbon steel.

Figure 1:
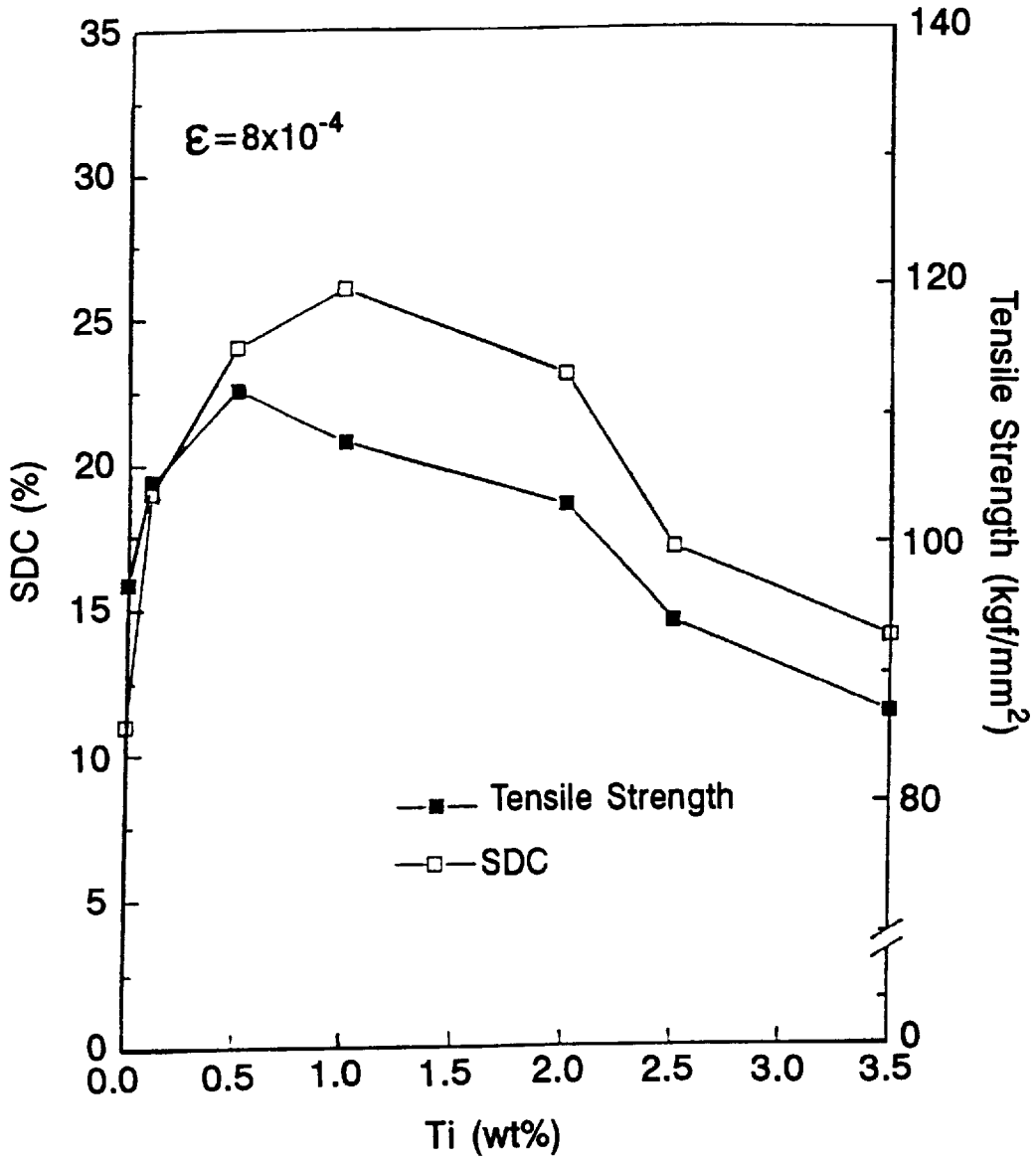
FIG. 1 is a graph for showing the change of tensile strength and vibration damping capacity of the steel containing Ti as an additive according to the present invention.

Further, referring to FIG. 1 showing the change of the vibration damping capacity and the tensile strength according to the addition of Ti, the vibration damping capacity is increased according to the increase of added quantity of Ti and recorded as the maximum value at 0.5 to 2.0% by weight of Ti, while the tensile strength is recorded as the maximum value at 0.1 to 1.0% by weight of Ti.

In other words, addition of Ti changes the carbons dispersed at and within the particle boundary to carbides, so as to cause reduction of solid soluble carbons having fixed $\gamma/\epsilon$ interface which yielded vibration damping effects. Accordingly, the movement of the $\gamma/\epsilon$ interface is freed to result in the increase of the vibration damping capacity.

When 0.5 to 1.0% by weight of Ti is added, complex function due to the precipitation strengthening by the carbides and solid solution strengthening of the remaining carbons enables high tensile strength of the vibration damping alloy steel. When Ti is more than or equal to 2.0% by weight, the solid soluble carbon is completely precipitated to carbides, so that only precipitation strengthening functions, thereby decreasing the tensile strength.

Figure 2:
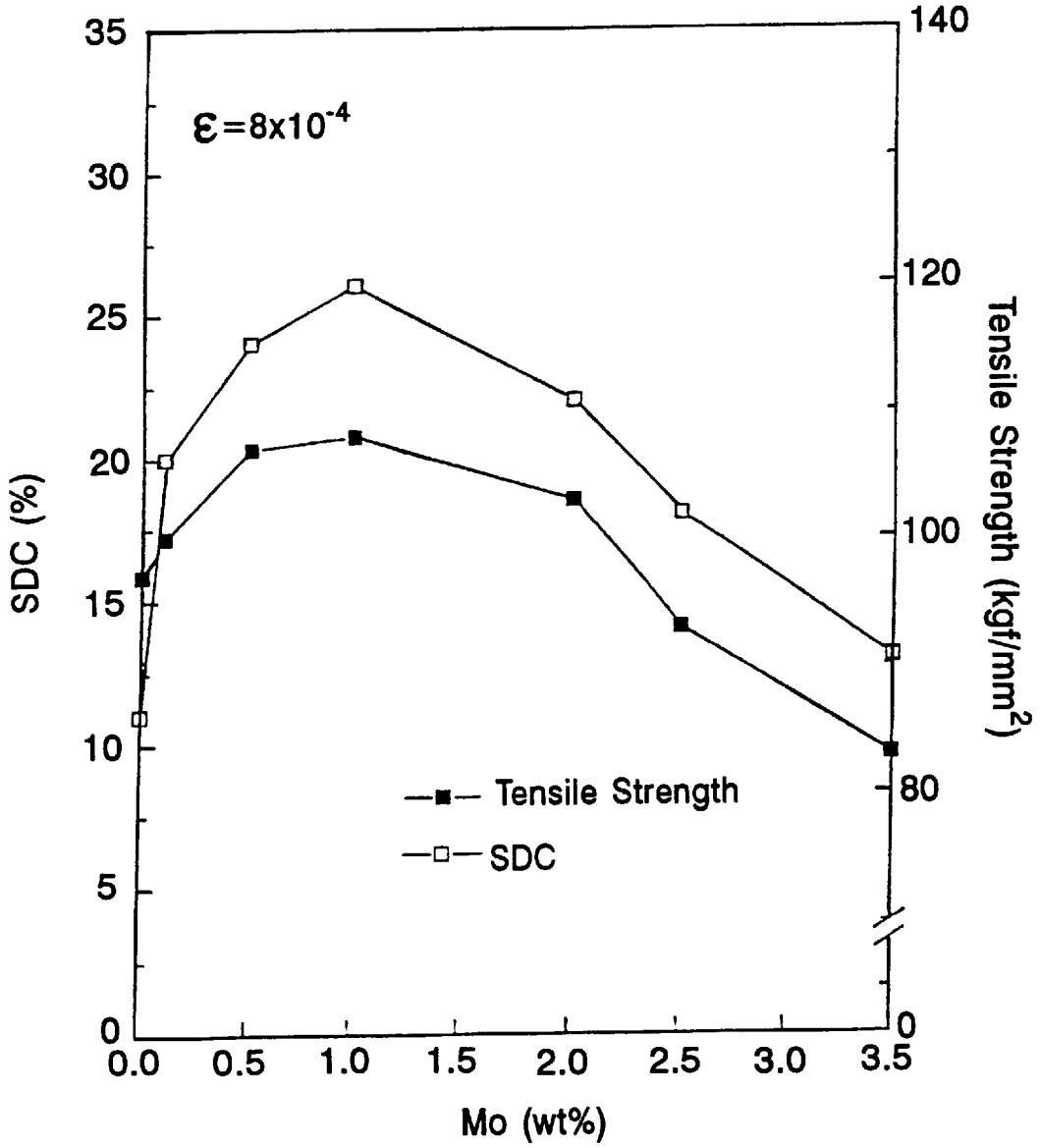
FIG. 2 is a graph for showing the change of tensile strength and vibration damping capacity of the steel containing Mo as an additive according to the present invention.

FIG. 2 shows the change of the vibration damping capacity and the tensile strength according to the addition of Mo to the alloy steel of the present invention. The vibration damping capacity is increased according to the increase of added quantity of Mo and recorded as the maximum value at 0.5 to 1.5% by weight of Mo, and the tensile strength is recorded as the maximum value also at 0.5 to 1.5% by weight of Mo.

Figure 3:
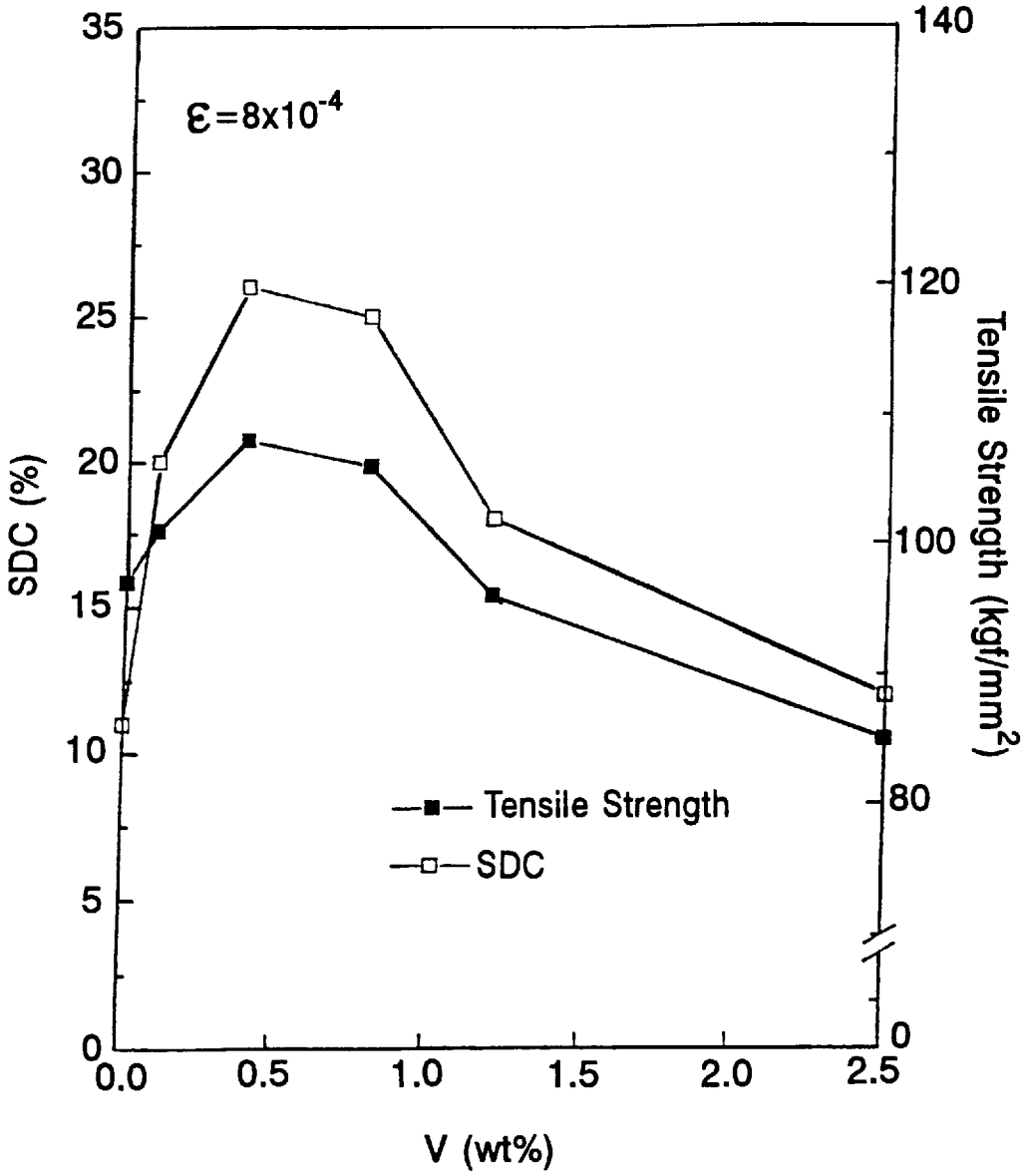
FIG. 3 is a graph for showing the change of tensile strength and vibration damping capacity of the steel containing V as an additive according to the present invention; according to the present invention.

FIG. 3 shows the change of the vibration damping capacity and the tensile strength according to the addition of V to the alloy steel of the present invention. The vibration damping capacity is increased according to the increase of added quantity of V and recorded as the maximum value at 0.4 to 0.8% by weight of V, and the tensile strength is recorded as the maximum value also at 0.4 to 0.8% by weight of V.

Figure 4:
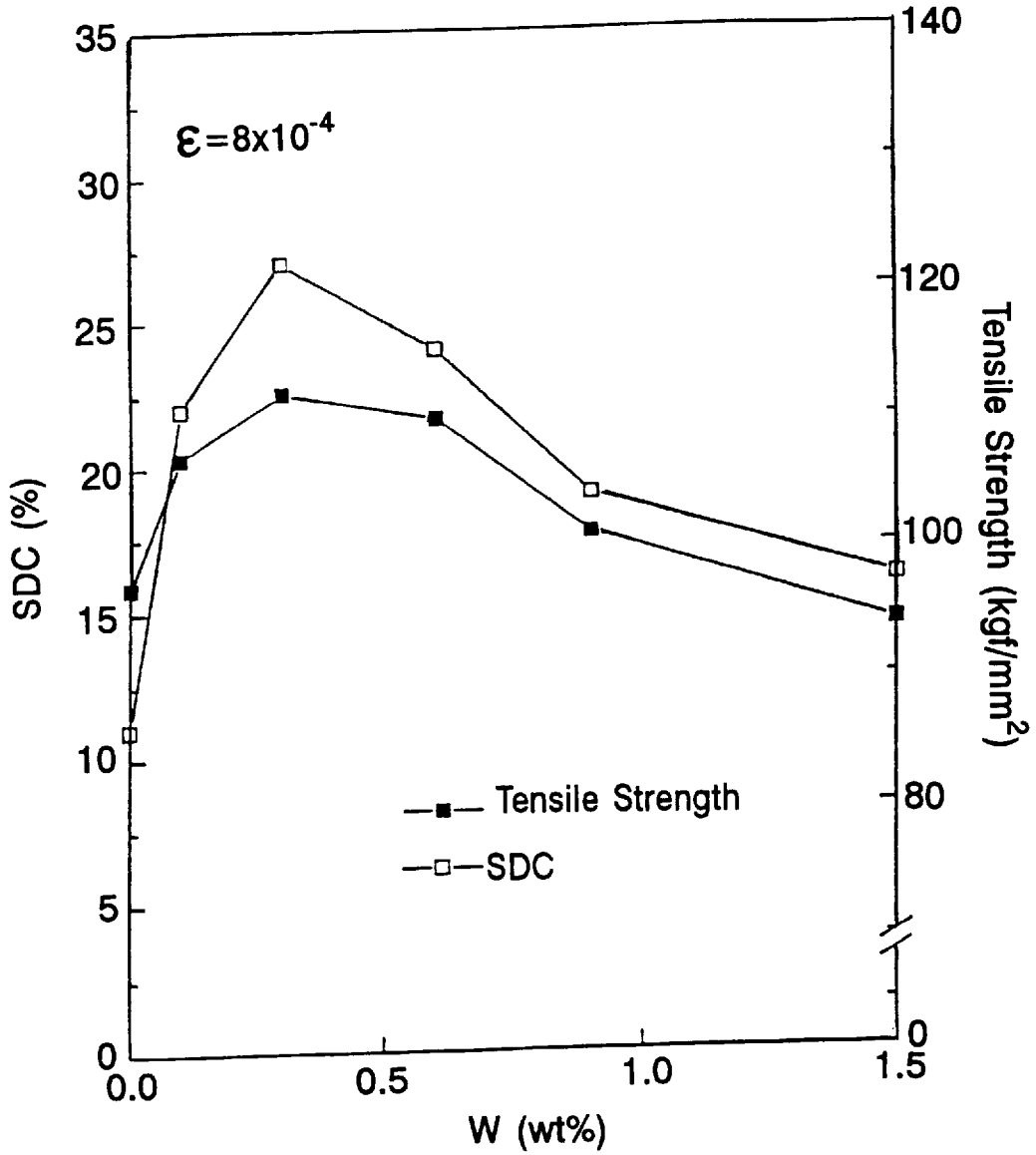
FIG. 4 is a graph for showing the change of tensile strength and vibration damping capacity of the steel containing W as an additive according to the present invention.

FIG. 4 shows the change of the vibration damping capacity and the tensile strength according to the addition of W to the alloy steel of the present invention. The vibration damping capacity is increased according to the increase of added quantity of W and recorded as the maximum value at 0.1 to 0.6% by weight of W, and the tensile strength is recorded as the maximum value also at 0.1 to 0.6% by weight of W.

EXAMPLE 2

In order to manufacture a vibration damping alloy steel having an improved corrosion resistance, iron is firstly charged into a melting furnace and heated at 1600° C. Then, predetermined amounts of Cr, Cu, and Nb which are elements for improving resistance to corrosion and decay, together with manganese, are charged into the furnace and then melted, respectively as shown in table 2. Thereafter, similarly as is in example 1, the melted mixture is cast into a mold to produce an ingot. Subsequently, the cast ingot is homogenized and hot-rolled to produce a rolled metal of a predetermined dimension. The rolled metal is heated and then cooled by air or water to produce an Fe—Mn type vibration damping alloy steel.

Figure 6A:
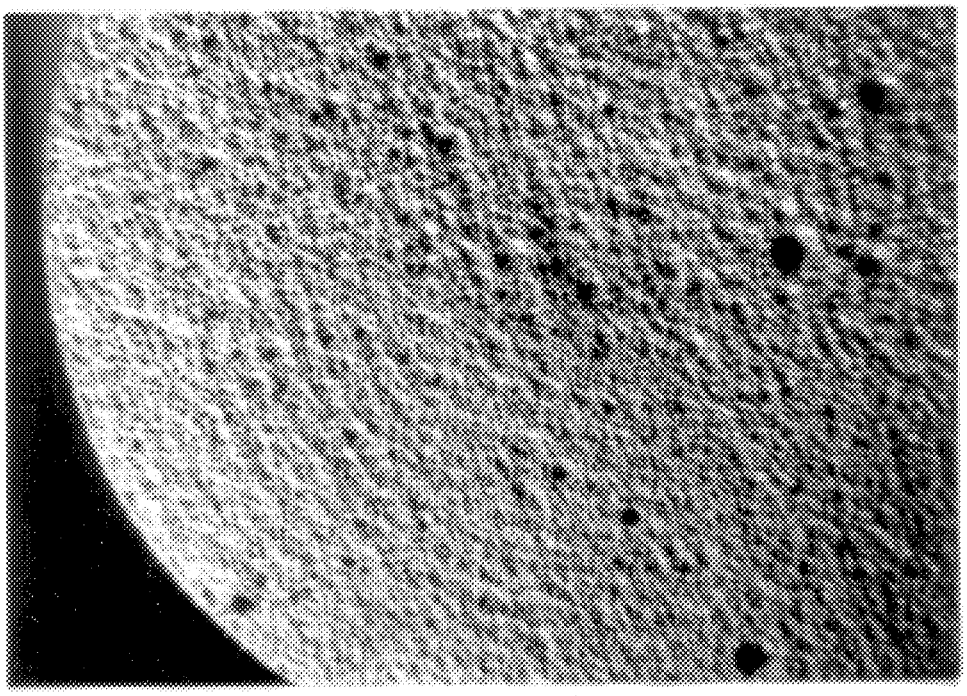
FIGS. 6A to 6E are photographs for showing corroded states of the conventional steel and the steel of the present invention after they are digested for two hundred hours.
Figure 6B:
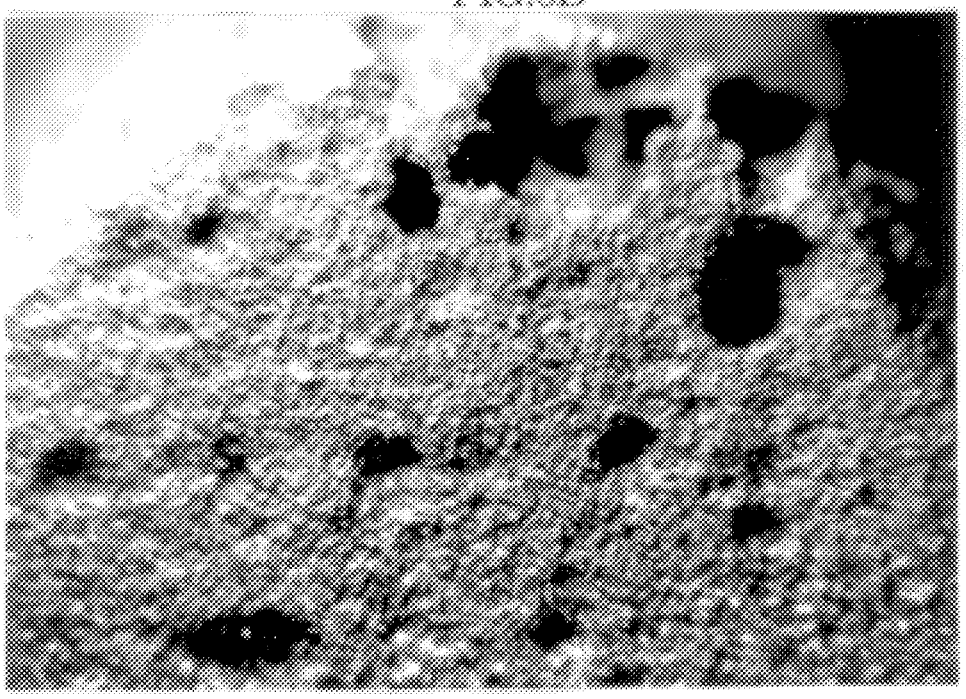
Figure 6C:
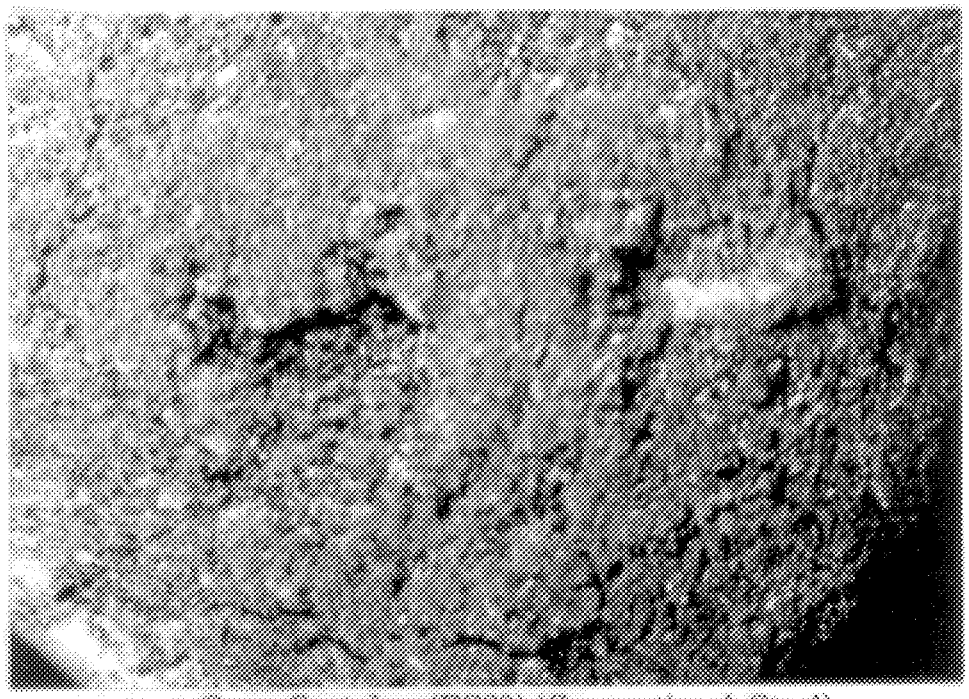
Figure 6D:
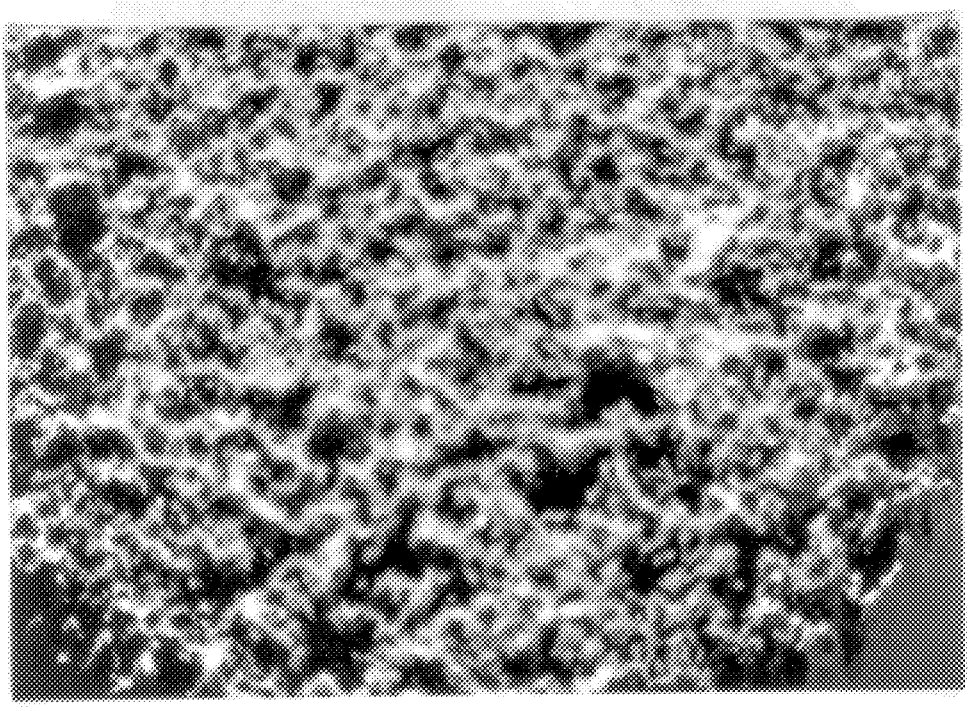
Figure 6E:
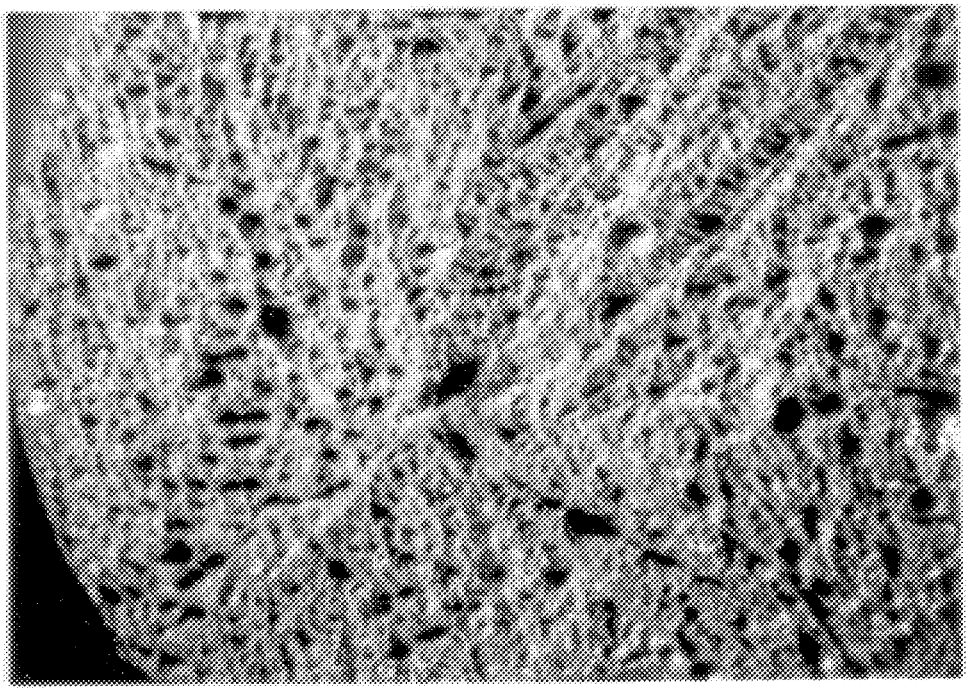
Figure 7:
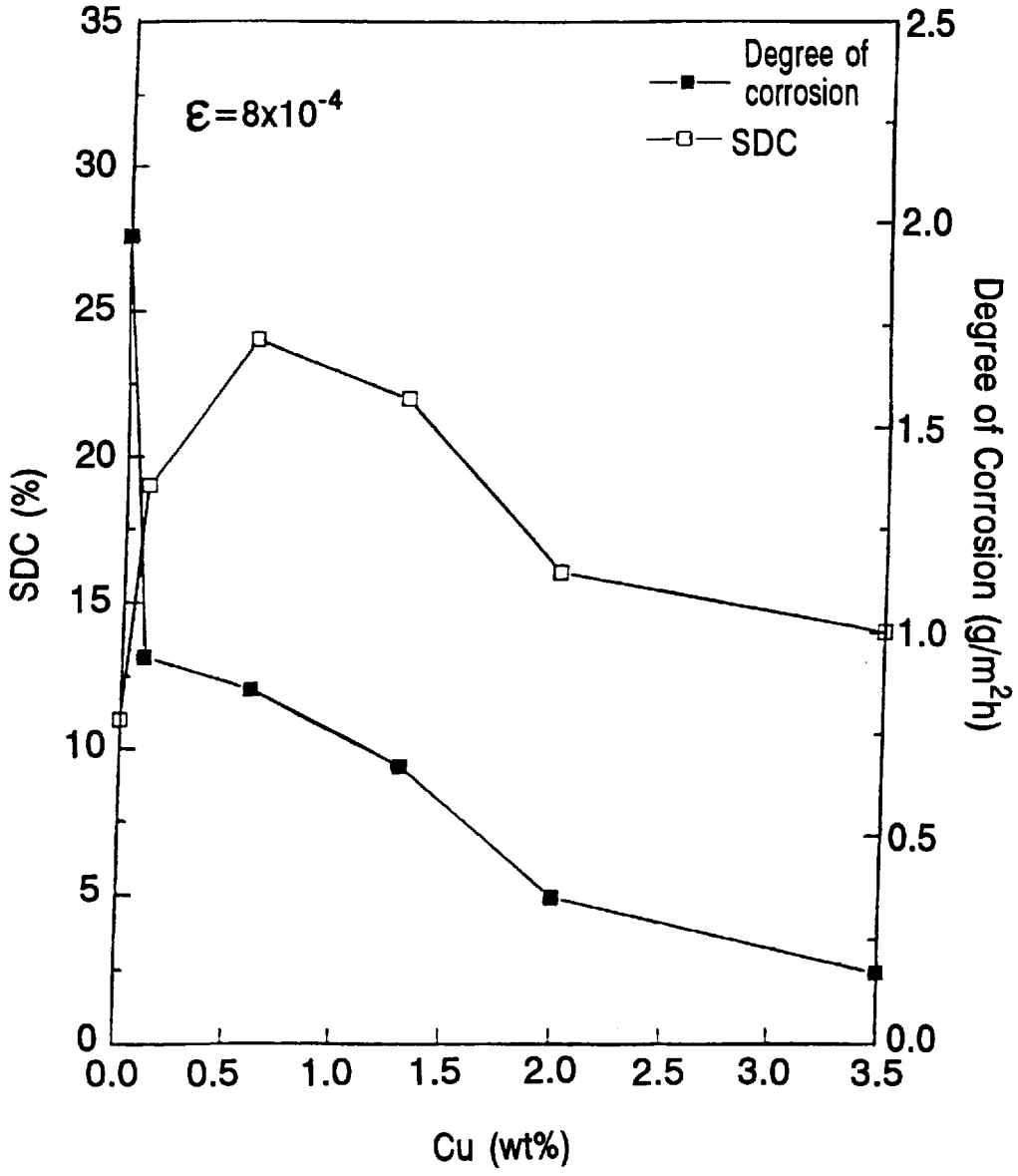
FIG. 7 is a graph for showing the change of the degree of corrosion and vibration damping capacity of the steel containing Cu as an additive according to the present invention.
Figure 8:
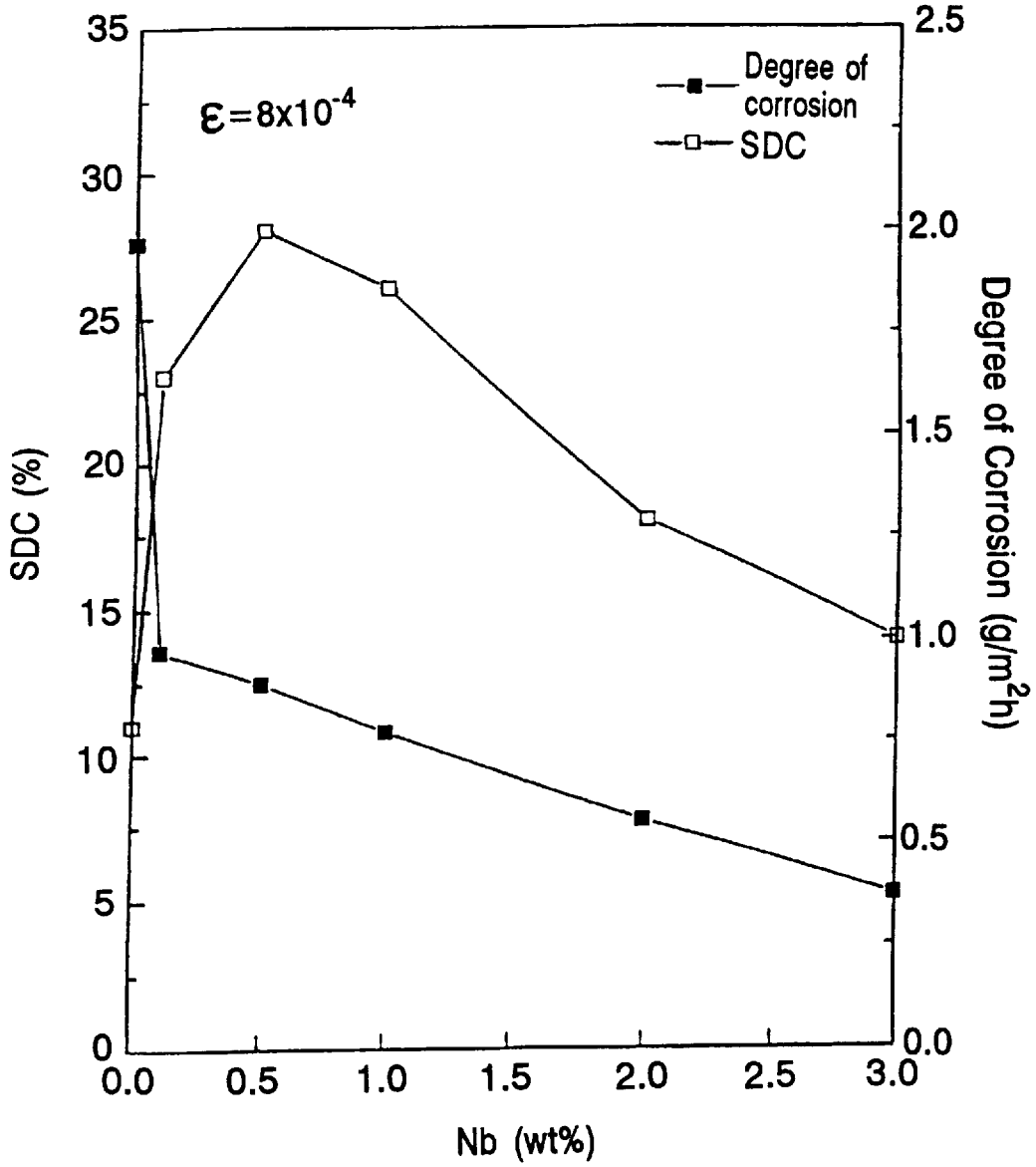
FIG. 8 is a graph for showing the change of degree of corrosion and vibration damping capacity of the steel containing Nb as an additive according to the present invention.

Table 2 and FIGS. 6, 7, and 8 show the composition of the alloy steel manufactured according the above process, and its vibration damping capacity and degree of corrosion.

FIGS. 6A to 6E are thirty-time-magnified photographs for detailedly showing corroded states of test pieces respectively of the conventional steel and the steel of the present invention containing elements for improving corrosion resistance, after they are immersed for two hundred hours to testify the degree of corrosion.

TABLE 2

| No. | Name of the alloy | Specific Damping Capacity (SDC, %) $\epsilon = 8 \times 10^{-4}$ | Degree of Corrsion ($g/m^2h$) Test after Immersing 200 hours | Test after exposing to air 200 days | Note |
|---|---|---|---|---|---|
| 1 | Fe-17% Mn-0.2% C-0.1% Cr | 19 | 11.05 | 1.22 | Inventive |
| 2 | Fe-17% Mn-0.2% C-1.5% Cr | 22 | 9.12 | 1.11 | Steel |
| 3 | Fe-17% Mn-0.2% C-2.5% Cr | 23 | 7.80 | 0.98 | |
| 4 | Fe-17% Mn-0.2% C-4.0% Cr | 21 | 6.10 | 0.78 | |
| 5 | Fe-17% Mn-0.2% C-0.5% Cr-0.3% Cu | 25 | 9.89 | 0.74 | |
| 6 | Fe-17% Mn-0.2% C-0.5% Cr-0.5% Nb | 26 | 8.76 | 0.72 | |
| 7 | Fe-17% Mn-0.2% C-0.5% Cu-0.2% Nb | 24 | 9.14 | 0.77 | |
| 8 | Fe-17% Mn-0.2% C-0.5% Cr-0.5% Cu-0.2% Nb | 23 | 7.34 | 0.68 | |
| 9 | Fe-17% Mn-0.2% C-0.1% Cu | 19 | 11.32 | 0.94 | |
| 10 | Fe-17% Mn-0.2% C-0.6% Cu | 24 | 9.67 | 0.86 | |
| 11 | Fe-17% Mn-0.2% C-1.3% Cu | 22 | 7.45 | 0.67 | |
| 12 | Fe-17% Mn-0.2% C-0.1% Nb | 23 | 11.78 | 0.97 | |
| 13 | Fe-17% Mn-0.2% C-0.5% Nb | 28 | 10.22 | 0.89 | |
| 14 | Fe-17% Mn-0.2% C-1.0% Nb | 26 | 8.56 | 0.77 | |
| 15 | Fe-17% Mn-0.2% C-5.0% Cr | 16 | 4.94 | 0.27 | Comparative |
| 16 | Fe-17% Mn-0.2% C-6.0% Cr | 14 | 3.87 | 0.19 | Steel |
| 17 | Fe-17% Mn-0.2% C-2.0% Cu | 16 | 5.89 | 0.35 | |
| 18 | Fe-17% Mn-0.2% C-3.5% Cu | 14 | 4.74 | 0.17 | |
| 19 | Fe-17% Mn-0.2% C-2.0% Nb | 18 | 6.58 | 0.55 | |
| 20 | Fe-17% Mn-0.2% C-3.0% Nb | 14 | 5.23 | 0.37 | |
| 21 | Fe-17% Mn-0.2% C | 11 | 14.97 | 1.97 | |
| 22 | Fe-17% Mn | 25 | 13.65 | 1.35 | Conventional |
| 23 | Carbon Steel(SC46) | 7 | 17.25 | 2.35 | Steel |
| 24 | Gray Cast Iron(FC20) | 16 | 22.05 | 5.95 | |
| 25 | Allomorphic iron reinforced bar | 6 | 20.71 | 3.39 | |

The vibration damping alloy steels of the present embodiment, No. 1 to No. 14 shown in Table 2, contain elements for improving corrosion resistance within predetermined ranges according to the present invention, while the comparative steels, No. 15 to No. 21, contain the elements for improving corrosion resistance which are but out of the predetermined ranges, and the conventional steels, No. 22 to No. 25, are the conventional vibration damping alloy steel, and the conventional carbon steel, gray cast iron and allomorphic iron reinforced bar, which do not contain the elements improving corrosion resistance.

In measuring the corrosion resistance and the resistance to decay by the KS D 0222 testing method, a rod-shaped test piece with a diameter of 20 mm and a thickness of 20 mm is used. The test piece is digested in a solution of 5% sulfric acid for two hundred hours. Thereafter, the corroded product of the test piece is pickled by 30% nitric acid at room temperature, and then the weight-reduction of the test piece is measured by weighing the test piece. The weight of the test piece is measured to the unit of 0.1 mg before and after the test. The degree of corrosion is indicated by the weight per unit area multiplied by unit time ($g/m^2h$), which weight is the reduced value after the test. The degree of corrosion is calculated down to the second decimal place according to KS A 0021.

The working effect of the vibration damping alloy steel having a superior corrosion resistance according to the present invention will be described hereinbelow, with reference to Table 2, and FIGS. 5 to 8.

No. 1 to No. 4 vibration damping alloy steels of the present invention containing Cr reveal superior corrosion resistance to No. 15 and No. 16 comparative steels which also contain Cr but out of the predetermined range, and have a corrosion resistance more than three times superior to those of Nos. 22 and 25 steels, the conventional Fe—Mn vibration damping alloy steel and the conventional carbon steel.

No. 9 to No. 11 vibration damping alloy steels of the present invention containing Cu have a superior vibration damping capacity and a superior corrosion resistance to No. 17 and No. 18 comparative steels which also contain Cu but out of the predetermined range, and have a corrosion resistance more than two times superior to those of Nos. 22 and 25 steels including the conventional Fe—Mn vibration damping alloy steel and the conventional carbon steel.

No. 12 to No. 14 vibration damping alloy steels of the present invention containing Nb have a superior vibration damping capacity and a superior corrosion resistance to No. 19 and No. 20 compared steels which also contain Nb but out of the predetermined range, and have a corrosion resistance more than two times superior to those of Nos. 22 and 25 steels including the conventional Fe—Mn vibration damping alloy steel and the conventional carbon steel.

Also, No. 5 to No. 8 vibration damping alloy steels of the present invention containing at least two elements selected from the group consisting of Cr, Cu and Nb exhibit a superior vibration damping capacity and a superior corrosion resistance, in comparison with the compared steels and the conventional steels.

Figure 5:
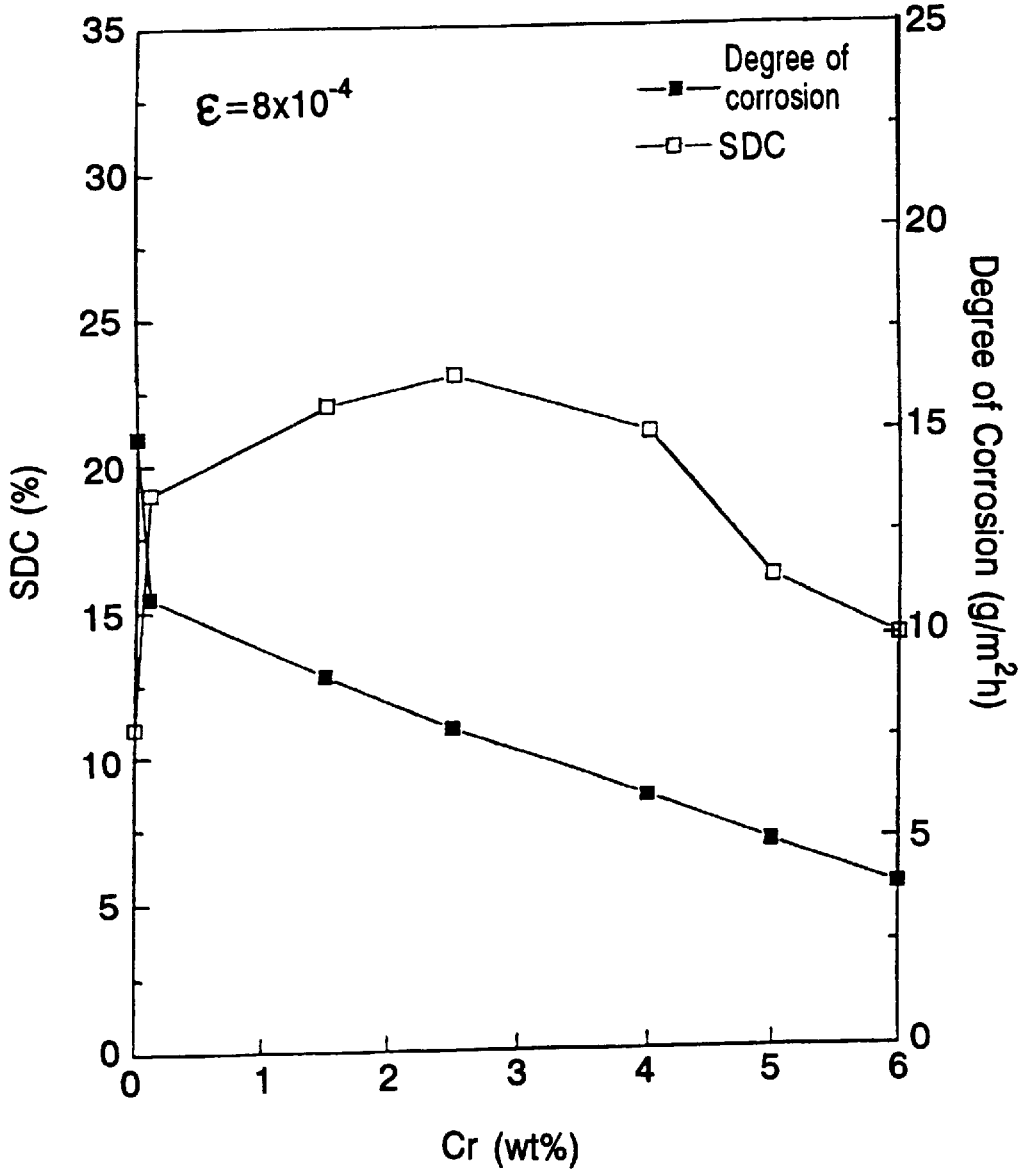
FIG. 5 is a graph for showing the change of degree of corrosion and vibration damping capacity of the steel containing Cr as an additive according to the present invention.

FIG. 5 shows the change of the vibration damping capacity and the degree of corrosion according to the addition of Cr to the alloy steel of the present invention. The vibration damping capacity is increased according to the increase of added quantity of Cr and recorded as the maximum value at 1.5 to 4.0% by weight of Cr, while the degree of corrosion is lowered down to improve the corrosion resistance according to the increase of added quantity of Cr.

That is, addition of Cr changes the carbons dispersed at and within the particle boundary to carbides, so as to cause reduction of solid soluble carbons having fixed $\gamma/\epsilon$ interface which yielded vibration damping effects. Accordingly, the movement of the $\gamma/\epsilon$ interface is freed to result in the increase of the vibration damping capacity. On the other hand, the corrosion resistance is improved in proportion to the added quantity of Cr due to its capacity of resisting to corrosion.

FIGS. 6A to 6E are stereoscopic photographs with a magnification of ×30, for showing corroded states of test pieces respectively of the conventional steel and the steel of the present invention containing Cr, after they are digested for two hundred hours.

FIG. 6A shows a uniform corrosion on the alloy steel of the present invention, while FIGS. 6B to 6E show local corrosions on the conventional alloy steels. That is, damage by the uniform corrosion on the alloy steel of the present invention can be preestimated and controlled, while it is very difficult to preestimate such local corrosions as those on the conventional alloy steels.

Especially, it is very difficult to derive a formula for the local corrosions, because the distribution, size and etc. of the pits on the surface of the steel depend on fine structure of the metal, detailed change of the corrosive environment, and etc.

FIG. 7 shows the change of the vibration damping capacity and the degree of corrosion according to the addition of Cu to the alloy steel of the present invention. The vibration damping capacity is increased according to the increase of added quantity of Cu and recorded as the maximum value at 0.3 to 1.3% by weight of Cu, while the degree of corrosion is lowered down to improve the corrosion resistance according to the increase of added quantity of Cu.

FIG. 8 shows the change of the vibration damping capacity and the degree of corrosion according to the addition of Nb to the alloy steel of the present invention. The vibration damping capacity is increased according to the increase of added quantity of Nb and recorded as the maximum value at 0.3 to 1.0% by weight of Nb, while the degree of corrosion is lowered down to improve the corrosion resistance according to the increase of added quantity of Nb.

As described above, the present invention provides a vibration damping alloy steel which has not only an improved vibration damping capacity but a superior tensile strength more than 100 kgf/mm$^2$ which is about three times of the tensile strength, 30 to 40 kgf/mm$^2$, of the existing material.

Therefore, the present invention enables to reduce the manufacturing cost of the vibration damping alloy steel and to manufacture more light vibration damping alloy steel.

In addition, the present invention provides a vibration damping alloy steel which has a much improved corrosion resistance and resistance to decay.

Therefore, the present invention enables to prolong the life of the steel and to prevent or minimize damage produced by the local corrosions, so as to guarantee the safety for the construction using the steel of the present invention and have a useful effect on the side of preservation of natural resources.

While the invention has been shown and described with reference to a preferred embodiment, it should be apparent to one of ordinary skill in the art that many modifications may be made without departing from the spirit and scope of the invention as defined in the claims.

What is claimed is:

1. An Fe—Mn vibration damping alloy steel having a superior tensile strength, consisting of, by weight percent:

10 to 24% of Manganese(Mn); up to 0.2% of carbon(C); at least one element selected from the group consisting of 0.1 to 2.0% of Titanium(Ti), 0.1 to 2.0% of Molybdenium (Mo), 0.1 to 1.0% of Vanadium (V), and 0.1 to 0.7% of Tungsten (W), the element increasing tensile strength and vibration damping capacity of the alloy steel; and remaining iron(Fe) and incidental impurities.

2. An Fe—Mn vibration damping alloy steel having a good corrosion resistance, consisting of, by weight percent:

10 to 24 of Manganese (Mn); up to 0.2% of carbon(C); at least one element selected from the group consisting of 0.1 to 4.5% of Chromium(Cr), 0.1 to 1.5% of Copper (Cu), and 0.1 to 1.1% of Niobium(Nb), the element increasing corrosion resistance and vibration damping capacity of the alloy steel; and remaining iron(Fe) and incidental impurities.

* * * * *